US012163443B2

(12) United States Patent
Watanabe et al.

(10) Patent No.: US 12,163,443 B2
(45) Date of Patent: Dec. 10, 2024

(54) TURBINE ROTOR BLADE AND TURBINE

(71) Applicant: MITSUBISHI HEAVY INDUSTRIES AERO ENGINES, LTD., Komaki (JP)

(72) Inventors: Toshio Watanabe, Tokyo (JP); Kentaro Akimoto, Komaki (JP)

(73) Assignee: MITSUBISHI HEAVY INDUSTRIES AERO ENGINES, LTD., Komaki (JP)

( * ) Notice: Subject to any disclaimer, the term of this patent is extended or adjusted under 35 U.S.C. 154(b) by 0 days.

(21) Appl. No.: 18/283,144

(22) PCT Filed: Feb. 8, 2022

(86) PCT No.: PCT/JP2022/004908
§ 371 (c)(1),
(2) Date: Sep. 20, 2023

(87) PCT Pub. No.: WO2022/201926
PCT Pub. Date: Sep. 29, 2022

(65) Prior Publication Data

US 2024/0167384 A1 May 23, 2024

(30) Foreign Application Priority Data

Mar. 24, 2021 (JP) ..... 2021-050679

(51) Int. Cl.
*F01D 5/10* (2006.01)

(52) U.S. Cl.
CPC ..... *F01D 5/10* (2013.01)

(58) Field of Classification Search
CPC ..... F01D 5/10; F01D 5/22
See application file for complete search history.

(56) References Cited

U.S. PATENT DOCUMENTS

| | | | | |
|---|---|---|---|---|
| 5,373,922 | A | 12/1994 | Marra | |
| 6,042,336 | A | 3/2000 | Bulgrin et al. | |
| 11,002,140 | B2 * | 5/2021 | Schlemmer | F01D 5/26 |
| 2011/0255973 | A1 | 10/2011 | Borufka et al. | |
| 2013/0280083 | A1 | 10/2013 | Hartung | |

(Continued)

FOREIGN PATENT DOCUMENTS

| | | | |
|---|---|---|---|
| EP | 2484870 | A1 | 8/2012 |
| GB | 2255138 | A | 10/1992 |

(Continued)

OTHER PUBLICATIONS

PCT/ISA/210, "International Search Report for PCT International Application No. PCT/JP2022/004908, " Mar. 29, 2022.

(Continued)

*Primary Examiner* — Courtney D Heinle
*Assistant Examiner* — John S Hunter, Jr.
(74) *Attorney, Agent, or Firm* — HAUPTMAN HAM, LLP

(57) ABSTRACT

A turbine rotor blade includes: a rotor blade body which includes a blade root fixed to a rotation shaft extending along an axis, a base portion integrally formed on the outer radial side of the blade root, a blade body integrally formed on the outer radial side of the base portion, and a fin protruding from an axial end surface of the base portion; and a damper piece which is provided across an inner peripheral region of the axial end surface on the inner radial side of the fin and an inner peripheral surface of the fin facing the inner radial side.

7 Claims, 7 Drawing Sheets

(56) References Cited

U.S. PATENT DOCUMENTS

| | | | |
|---|---|---|---|
| 2016/0138401 | A1 | 5/2016 | Hartung et al. |
| 2017/0044922 | A1 | 2/2017 | Shapiro |
| 2019/0128120 | A1 | 5/2019 | Hartung |

FOREIGN PATENT DOCUMENTS

| | | | |
|---|---|---|---|
| JP | 2000-161005 | A | 6/2000 |
| JP | 2017-036730 | A | 2/2017 |

OTHER PUBLICATIONS

PCT/ISA/237, "Written Opinion for PCT International Application No. PCT/JP2022/004908," Mar. 29, 2022.

* cited by examiner

TURBINE ROTOR BLADE AND TURBINE

TECHNICAL FIELD

The present disclosure relates to a turbine rotor blade and a turbine.

Priority is claimed on Japanese Patent Application No. 2021-050679, filed Mar. 24, 2021, the content of which is incorporated herein by reference.

BACKGROUND ART

A turbine rotor blade includes a blade root which is attached to a rotation shaft, a base portion which is integrally provided on the outer radial side of the blade root and is formed by a shank and a platform, and a blade body which extends from the base portion toward the outer radial side. The base portion is provided with a fin which protrudes from the base portion in the axial direction. The fin suppresses the flow of a combustion gas from entering between a turbine stator blade and the rotation shaft.

Here, for example, Patent Document 1 discloses an example in which a damper is applied to a turbine rotor blade of a gas turbine of an aircraft field. When the turbine rotor blade rotates, the vibration of the turbine rotor blade is reduced by a frictional force generated between the turbine rotor blade and the damper.

CITATION LIST

Patent Document(s)

Patent Document 1: Japanese Unexamined Patent Application. First Publication No. 2000-161005

SUMMARY OF INVENTION

Technical Problem

Incidentally, since the weight reduction and high aspect ratio of the turbine rotor blade have progressed in recent years, it has become difficult to ensure the physical strength of the turbine rotor blade itself. Further, it is necessary to further improve vibration damping properties in order to achieve higher performance and higher output.

The present disclosure has been made to solve the above-described problems and an object thereof is to provide a turbine rotor blade and a turbine capable of improving vibration damping properties while ensuring physical strength.

Solution to Problem

In order to solve the above-described problems, a turbine rotor blade according to the present disclosure includes: a rotor blade body which includes a blade root fixed to a rotation shaft extending along an axis, a base portion integrally formed on the outer radial side of the blade root, a blade body integrally formed on the outer radial side of the base portion, and a fin protruding from an axial end surface of the base portion; and a damper piece which is provided across an inner peripheral region of the axial end surface on the inner radial side of the fin and an inner peripheral surface of the fin facing the inner radial side of the fin.

A turbine according to the present disclosure includes: the rotation shaft; and the turbine rotor blades arranged on the rotation shaft in a circumferential direction, wherein the damper piece is provided across the rotor blade bodies adjacent to each other in the circumferential direction.

Advantageous Effects of Invention

According to the present disclosure, it is possible to provide the turbine rotor blade and the turbine capable of improving vibration damping properties while ensuring physical strength.

DESCRIPTION OF EMBODIMENTS

First Embodiment

Figure 1:
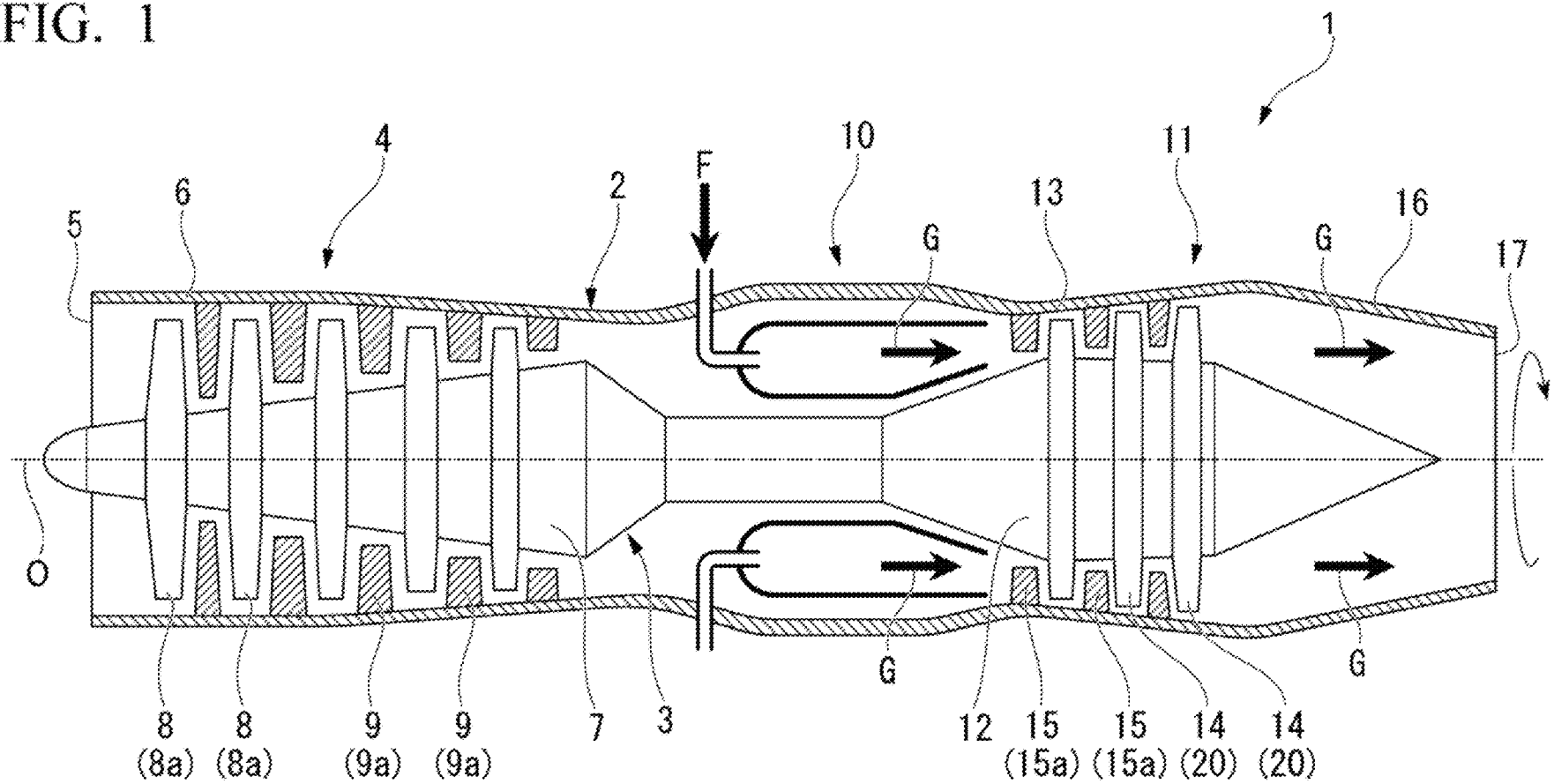
FIG. 1 is a longitudinal sectional view showing a schematic configuration of an aircraft gas turbine according to a first embodiment of the present disclosure.

Hereinafter, a gas turbine 1 according to a first embodiment of the present disclosure will be described with reference to FIGS. 1 to 4.

(Configuration of Gas Turbine)

A gas turbine 1 of this embodiment is used as an aircraft engine. The gas turbine 1 includes a compressor 4, a combustion chamber 10, and a turbine 11.

The compressor 4 generates high-pressure air by compressing air taken in from an intake duct 5. The compressor 4 includes a compressor casing 6, a compressor rotor shaft 7, a compressor rotor blade stage 8, and a compressor stator blade stage 9. The compressor casing 6 covers the compressor rotor shaft 7 from the outer peripheral side and extends in the extension direction of the axis O (hereinafter, referred to as the direction of the axis O).

A plurality of the compressor rotor blade stages 8 are provided in the compressor rotor shaft 7. These compressor rotor blade stages 8 are arranged at intervals in the direction of the axis O. Each of the plurality of compressor rotor blade stages 8 includes a plurality of compressor rotor blades 8*a*. The compressor rotor blade 8*a* extends in a direction along the radius of an imaginary circle centered on the axis O (hereinafter, referred to as the radial direction). The compressor rotor blades 8*a* of each compressor rotor blade stage 8 are arranged on the outer peripheral surface of the compressor rotor shaft 7 in a direction centered on the axis O (hereinafter, referred to as the circumferential direction).

A plurality of the compressor stator blade stages 9 are provided in the compressor casing 6. These compressor stator blade stages 9 are arranged at intervals in the direction of the axis O. The compressor stator blade stages 9 are alternately arranged with the compressor rotor blade stages 8 in the direction of the axis O. Each of the plurality of compressor stator blade stages 9 includes a plurality of compressor stator blades 9*a*. The compressor stator blades 9*a* of each compressor stator blade stage 9 are arranged on the inner peripheral surface of the compressor casing 6 in the circumferential direction.

The combustion chamber 10 generates a combustion gas G by mixing fuel F with the high-pressure air generated by the compressor 4 and combusting the mixture. The combustion chamber 10 is provided between the compressor casing 6 and a turbine casing 13 of the turbine 11. The combustion gas G generated by the combustion chamber 10 is supplied to the turbine 11.

The turbine 11 is driven by the high-temperature and high-pressure combustion gas G generated in the combustion chamber 10. More specifically, the turbine 11 expands the high-temperature and high-pressure combustion gas G to convert the thermal energy of the combustion gas G into rotational energy. This turbine 11 includes the turbine casing 13, a turbine rotor shaft (rotation shaft) 12, a turbine rotor blade stage 14, and a turbine stator blade stage 15.

The turbine casing 13 covers the turbine rotor shaft 12 from the outer peripheral side. The turbine casing 13 and the compressor casing 6 are integrally connected along the axis O. The compressor casing 6 and the turbine casing 13 constitute a gas turbine casing 2.

The turbine rotor shaft 12 extends in the direction of the axis O. The turbine rotor shaft 12 and the compressor rotor shaft 7 are arranged side by side in the direction of the axis O not to be relatively movable. The turbine rotor shaft 12 and the compressor rotor shaft 7 constitute a gas turbine rotor shaft 3. This gas turbine rotor shaft 3 is integrally rotatable around the axis O inside the gas turbine casing 2.

A plurality of the turbine rotor blade stages 14 are provided on the outer peripheral surface of the turbine rotor shaft 12 at intervals in the direction of the axis O. Each of the plurality of turbine rotor blade stages 14 includes a plurality of turbine rotor blades 20 (details will be described later). The plurality of turbine rotor blades 20 of one turbine rotor blade stage 14 are arranged side by side at equal pitches in the circumferential direction.

A plurality of the turbine stator blade stages 15 are provided on the inner peripheral surface of the turbine casing 13 at intervals in the direction of the axis O. The plurality of turbine stator blade stages 15 are alternately arranged with the turbine rotor blade stages 14 in the direction of the axis O. Each of the turbine stator blade stages 15 includes a plurality of turbine stator blades 15*a*. The turbine stator blades 15*a* provided in each turbine stator blade stage 15 are arranged side by side at equal pitches in the circumferential direction on the inner peripheral surface of the turbine casing 13.

In order to operate the gas turbine 1 with the above-described configuration, the compressor rotor shaft 7 is first rotationally driven by an external drive source. As the compressor rotor shaft 7 rotates, external air is sequentially compressed to generate high-pressure air. This high-pressure air is supplied into the combustion chamber 10 through the compressor casing 6. In the combustion chamber 10, the fuel F is mixed with the high-pressure air and then combusted to generate the high-temperature and high-pressure combustion gas G. The combustion gas G is supplied into the turbine 11 through the turbine casing 13. In the following description, the side in which the combustion gas G flows is referred to as the "upstream side" and the opposite side is referred to as the "downstream side" in both sides of the direction of the axis O.

In the turbine 11, the combustion gas G sequentially collides with the turbine rotor blade stage 14 and the turbine stator blade stage 15 to give rotational driving force to the turbine rotor shaft 12. This rotational energy is mainly used to drive the compressor 4. The combustion gas G having driven the turbine 11 is increased in flow velocity by an exhaust nozzle 16 to become a jet that generates thrust and is discharged to the outside from an injection port 17.

(Turbine Rotor Blade)

Figure 2:
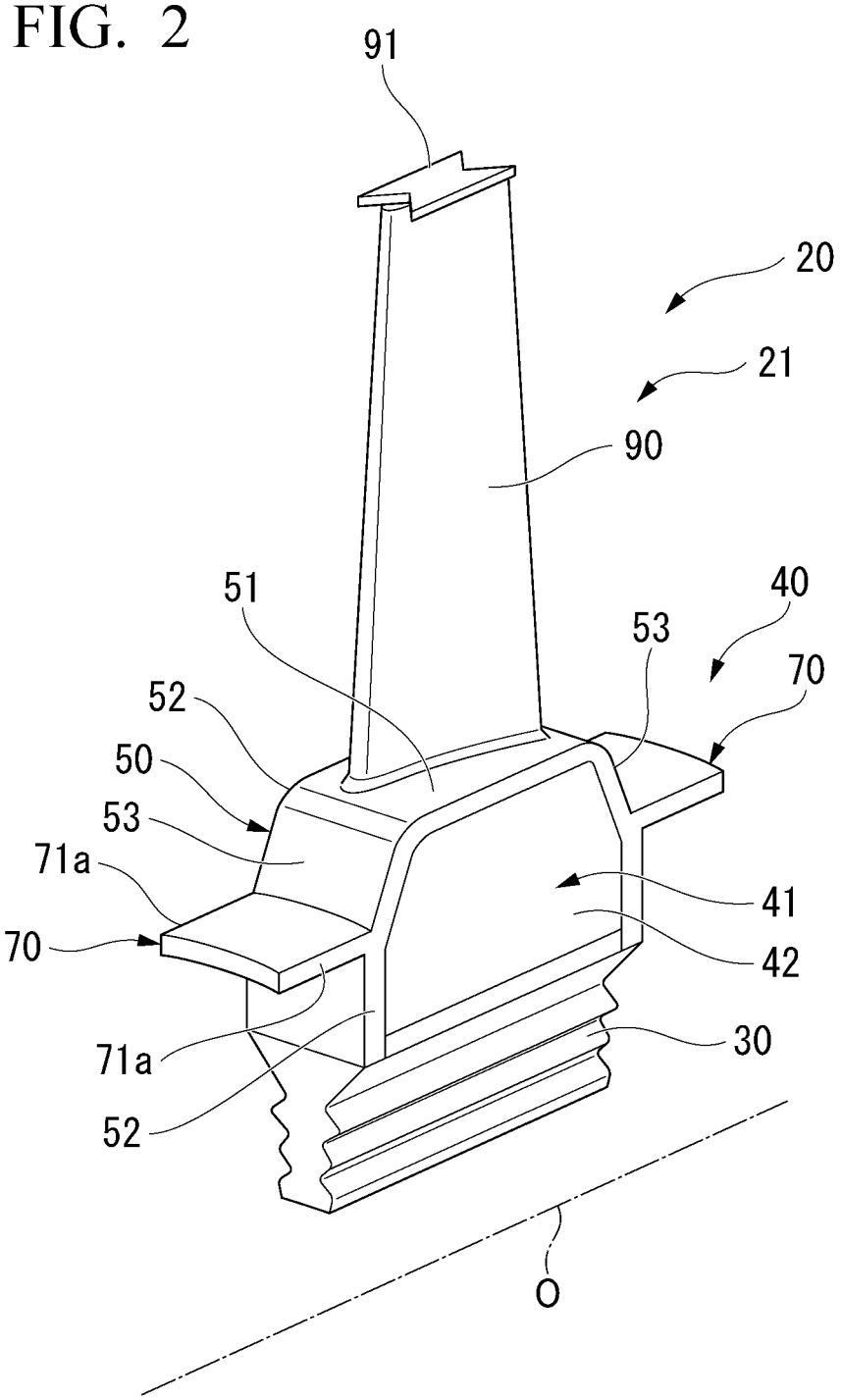
FIG. 2 is a perspective view of a turbine rotor blade according to the first embodiment of the present disclosure.

Next, the overall configuration of a rotor blade body 21 of the turbine rotor blade 20 will be described with reference to FIG. 2. The rotor blade body 21 includes a blade root 30, a base portion 40, a fin 70, a blade body 90, and a shroud 91.

(Blade Root)

The blade root 30 is provided at the inner radial end portion of the rotor blade body 21. The blade root 30 fixes the rotor blade body 21 to the turbine rotor shaft 12. The blade root 30 has a so-called Christmas tree shape with unevenness formed on both sides in the circumferential direction. The blade root 30 has a uniform shape from one side in the direction of the axis O (the upstream side in the flow direction of the combustion gas G) to the other side in the direction of the axis O (the downstream side in the flow direction of the combustion gas G). The blade root 30 is inserted into a groove portion formed in the turbine rotor shaft 12 from the direction of the axis O so that the rotor blade body 21 is integrally fixed to the turbine rotor shaft 12.

(Base Portion)

The base portion 40 is provided on the outer radial side of the blade root 30. The base portion 40 includes a shank 41 and a platform 50.

(Shank)

The shank 41 is integrally fixed to the outer radial end portion of the blade root 30. Each of a pair of surfaces facing both circumferential sides of the shank 41 is a shank end surface 42. The shank end surface 42 has a planar shape along the radial direction and the direction of the axis O. A circumferential gap between the pair of shank end surfaces 42 of the shank 41 is larger than the circumferential dimension of the blade root 30.

(Platform)

The platform 50 is integrally provided in the shank 41. The platform 50 has a plate shape covering one side of the shank 41 in the direction of the axis O, the outside in the radial direction, and the other side in the direction of the axis O.

A surface facing the outer radial side of the platform 50 is an outer peripheral end surface 51 facing along the flow path of the combustion gas G.

Each of a pair of surfaces facing the circumferential direction of the platform 50 is a circumferential end surface 52. The circumferential end surface 52 has a U shape with an open on the inner radial side when viewed in the circumferential direction. The pair of circumferential end surfaces 52 are located on the outer circumferential side (in a direction separated from the circumferential center of the base portion 40 toward one side and the other side in the circumferential direction) in relation to the corresponding shank end surface 42 in the shank 41. In the platforms 50 of the adjacent rotor blade bodies 21, their circumferential end surfaces 52 face each other in the circumferential direction. A gap is formed between the platforms 50 of the adjacent rotor blade bodies 21.

Each of a pair of surfaces facing one side and the other side in the direction of the axis O of the platform 50 is an axial end surface 53. The upper end of the axial end surface 53 is connected to the end portion of the outer peripheral end surface 51 in the direction of the axis O. The lower end of the axial end surface 53 extends to the lower end of the base portion 40.

(Fin)

The fin 70 is formed to protrude in the direction of the axis O from the axial end surface 53 of the platform 50 in the base portion 40.

A pair of the fins 70 of this embodiment are provided to correspond to one axial end surface 53 in the direction of the axis O and the other axial end surface 53 in the direction of the axis O. That is, the fins 70 are provided on both the upstream side and the downstream side of the turbine rotor blade 20. Each of the pair of fins 70 is provided to protrude from each axial end surface 53 outward in the direction of the axis O (in a direction separated from the center of the rotor blade body 21 in the direction of the axis O in the direction of the axis O). That is, the fin 70 on one side in the direction of the axis O protrudes toward one side in the direction of the axis O and the fin 70 on the other side in the direction of the axis O protrudes toward the other side in the direction of the axis O.

The fin 70 has a plate shape extending in the direction of the axis O and the circumferential direction. The circumferential dimension of the fin 70 is the same as the circumferential dimension of the platform 50. Thus, a pair of fin circumferential end surfaces 71*a* facing the circumferential direction in the fin 70 are flush with the circumferential end surface 52 of the platform 50.

(Blade Body)

The blade body 90 is integrally fixed to the outer peripheral end surface 51 of the platform 50 and extends from the outer peripheral end surface 51 toward the outer radial side. A cross-sectional shape orthogonal to the radial direction of the blade body 90 has an airfoil shape. A surface facing one circumferential side in the blade body 90 is a ventral side surface and a surface facing the other circumferential side is a back side surface. When the combustion gas G flowing from the upstream side toward the downstream side collides with the ventral side surface, the rotor blade body 21 is rotated.

(Shroud)

The shroud 91 is integrally provided at the outer radial end portion of the blade body 90. The shroud 91 has a shape projecting in the direction of the axis O and the circumferential direction in relation to the outer radial end portion of the blade body 90. The shrouds 91 of the adjacent rotor blade bodies 21 contact each other through mutual contact surfaces.

(Damping Structure of Rotor Blade Body)

Figure 3:
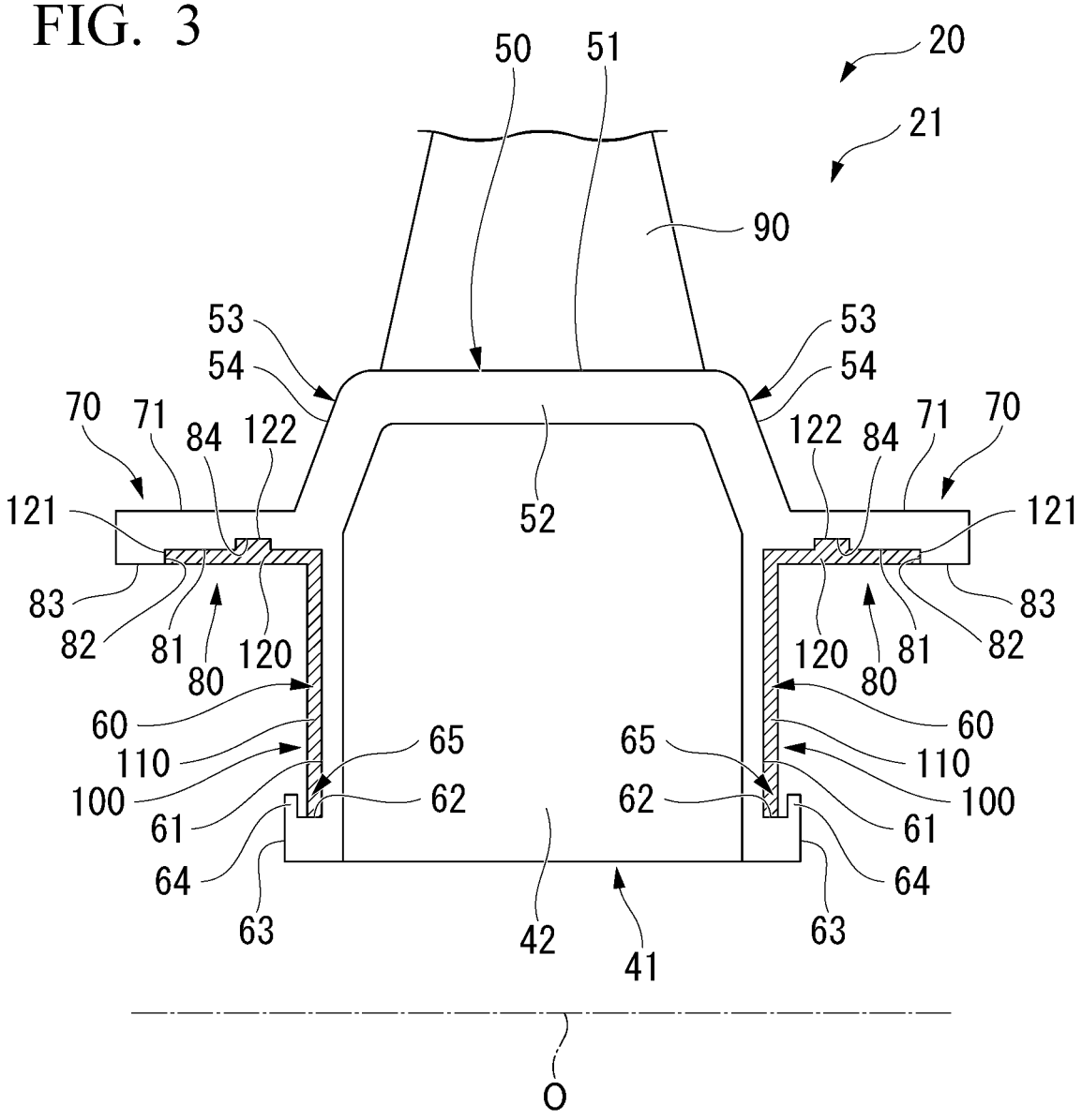
FIG. 3 is a longitudinal sectional view of a main part of the turbine rotor blade according to the first embodiment of the present disclosure.

Next, a damping structure of the turbine rotor blade 20 will be described in detail with reference to FIG. 3. The turbine rotor blade 20 further includes a damper piece 100 as a damping member. The damper piece 100 is provided on the outer surface of the rotor blade body 21. The damper piece 100 is provided across the fin 70 and the axial end surface 53 of the platform 50 of the base portion 40. In this embodiment, the damper piece 100 is provided on each of the upstream side and the downstream side of the turbine rotor blade 20.

(Detailed Structure of Base Portion)

The pair of axial end surfaces 53 of the platform 50 of the base portion 40 are divided into two parts in the radial direction by the respective corresponding fins 70. The outer radial portion of the fin 70 of the axial end surface 53 is an outer peripheral region 54. The outer radial end portion of the outer peripheral region 54 is connected to the outer peripheral end surface 51. The outer peripheral region 54 is inclined outward in the direction of the axis O as it goes toward the inner radial side.

(Inner Peripheral Region)

The inner radial region of the fin 70 in the axial end surface 53 is an inner peripheral region 60. The inner peripheral region 60 is a surface that faces the direction of the axis O and extends in the circumferential direction and the radial direction. The radial dimension of the inner peripheral region 60 is longer than the radial dimension of the outer peripheral region 54. That is, the fin 70 is provided at a position close to the outer radial side of the axial end surface 53.

The inner peripheral region 60 includes an inner peripheral end surface 63 and a first sliding contact surface 61.

The inner peripheral end surface 63 is a surface that forms the inner radial end portion of the axial end surface 53.

The first sliding contact surface 61 is a portion which is sandwiched between the inner peripheral end surface 63 and the fin 70 and is located to retreat inward in the direction of the axis O (in a direction close to the center of the rotor blade body 21 in the direction of the axis O) in relation to the inner peripheral end surface 63. That is, the first sliding contact surface 61 is a surface formed by cutting a part from the basic configuration of the base portion 40. The first sliding contact surface 61 has a planar shape extending in two directions of the circumferential direction and the direction of the axis O.

The inner radial end portion of the first sliding contact surface 61 is provided with a first contact portion 62 which projects outward in the direction of the axis O from the first sliding contact surface 61. The first contact portion 62 is formed at a step between the first sliding contact surface 61 and the inner peripheral end portion and faces the outer radial side. The first contact portion 62 is provided over the circumferential direction.

The outer end portion of the first contact portion 62 in the direction of the axis O is provided with a ridge portion 64 which is formed so that the inner peripheral end surface 63 is protruded toward the outer radial side. The ridge portion 64 is provided over the circumferential direction.

In this way, a groove-shaped structure that extends in the circumferential direction is formed by the first contact portion 62 and the ridge portion 64 in the first sliding contact surface 61. The groove is a damper insertion groove 65.

(Detailed Structure of Fin)

A surface that faces the outer radial side in the fin 70 is a fin outer peripheral surface 71 that extends in the direction of the axis O and the circumferential direction. The inner end portion of the fin outer peripheral surface 71 in the direction of the axis O is connected to the inner radial end portion of the outer peripheral region 54 in the axial end surface 53.

(Fin Inner Peripheral Surface)

A surface that faces the inner radial side of the fin 70 is a fin inner peripheral surface 80 that extends in the direction of the axis O and the circumferential direction.

The fin inner peripheral surface 80 includes a second sliding contact surface 81 and a tip inner surface 83.

The second sliding contact surface 81 is an inner portion of the fin inner peripheral surface 80 in the direction of the axis O and extends in the circumferential direction and the radial direction and the second sliding contact surface 81 may extend in a planar shape in the circumferential direction or may extend in a curved manner around the axis O as it goes in the circumferential direction.

The inner end portion of the second sliding contact surface 81 in the direction of the axis O is connected to the outer radial end portion of the inner peripheral region 60 in the axial end surface 53, that is, the outer radial end portion of the first sliding contact surface 61 over the circumferential direction. The first sliding contact surface 61 and the second sliding contact surface 81 are connected to be perpendicular to each other when viewed in the circumferential direction.

The tip inner surface 83 is an outer portion of the fin inner peripheral surface 80 in the direction of the axis O, that is, a tip portion of the fin 70. The tip inner surface 83 is disposed to be adjacent to the outside of the second sliding contact surface 81 in the direction of the axis O. The tip inner surface 83 is provided to advance to the inner radial side in relation to the tip inner surface 83. In other words, the second sliding contact surface 81 is recessed to retreat to the outer radial side in relation to the tip inner surface 83. That is, the second sliding contact surface 81 is a surface formed by cutting a part of the fin inner peripheral surface 80 of the fin 70.

A step surface between the second sliding contact surface 81 and the tip inner surface 83 is a second contact portion 82 that faces inward in the direction of the axis O. The second contact portion 82 extends over the circumferential direction.

A part of the second sliding contact surface 81 in the direction of the axis O is provided with a recessed portion 84 which is recessed toward the outer radial side from the second sliding contact surface 81 and extends over the circumferential direction. The recessed portion 84 is formed at a position separated from the outer end portion of the second sliding contact surface 81 in the direction of the axis O and the inner end portion thereof in the direction of the axis O, that is, an intermediate portion of the second sliding contact surface 81 in the direction of the axis O.

(Damper Piece)

The damper piece 100 is made of, for example, a Ni-based alloy or a metal such as titanium. As the damper piece 100, a high-damping metal may be adopted as long as the environment temperature in use is appropriate. The damper piece 100 includes a first plate portion 110 and a second plate portion 120. The thicknesses of the first plate portion 110 and the second plate portion 120 are set to, for example, 2 to 10 mm.

(First Plate Portion)

The first plate portion 110 has a rectangular plate shape that extends in the circumferential direction and the radial direction. That is, the sides of the first plate portion 110 extend to match the circumferential direction and the radial direction.

A surface that faces inward in the direction of the axis O of the first plate portion 110 comes into surface-contact with the first sliding contact surface 61 of the base portion 40. The inner radial end portion of the first plate portion 110 is fitted onto the first contact portion 62 in the radial direction. The inner radial end portion of the first plate portion 110 is stopped an outward movement thereof in the direction of the axis O by the ridge portion 64. That is, the inner radial end portion of the first plate portion 110 is inserted into the damper insertion groove 65 formed by the first contact portion 62 and the ridge portion 64.

(Second Plate Portion)

The second plate portion 120 has a plate shape that extends in the circumferential direction and the direction of the axis O. That is, the sides of the second plate portion 120 extend to match the circumferential direction and the direction of the axis O. The inner end portion of the second plate portion 120 in the direction of the axis O is connected to the outer radial end portion of the first plate portion 110 over the circumferential direction. Accordingly, the damper piece 100 has an L shape when viewed in the circumferential direction.

A surface that faces outward in the direction of the axis O of the second plate portion 120 comes into surface-contact with the second sliding contact surface 81 of the fin 70. The second plate portion 120 may have a flat plate shape or a plate shape curved around the axis O depending on the shape of the second sliding contact surface 81. The outer end portion of the second plate portion 120 in the direction of the axis O comes into contact with the second contact portion 82 from the inside of the direction of the axis O.

The damper piece 100 further includes a convex portion 122 which is formed in a part of the surface facing the outer radial side of the second plate portion 120 so that the convex portion protrudes from the surface toward the outer radial side and extends over the circumferential direction. The convex portion 122 has a corresponding shape at a position corresponding to the recessed portion 84 of the fin inner peripheral surface 80. Accordingly, the convex portion 122 of the damper piece 100 is fitted into the recessed portion 84 in a state in which the damper piece 100 is attached to the rotor blade body 21.

Figure 4:
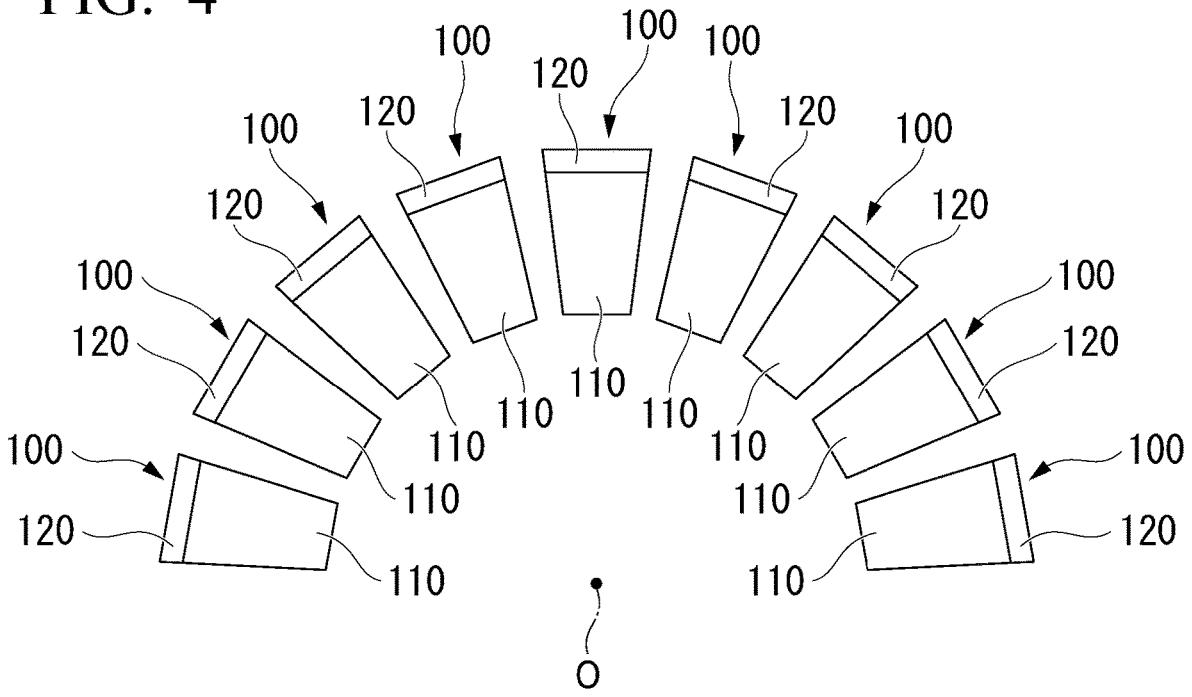
FIG. 4 is a diagram in which a damper piece of the turbine rotor blade according to the first embodiment of the present disclosure is viewed from the axial direction.

As shown in FIG. 4, the damper piece 100 described above has a divided structure in which the plurality of damper pieces 100 are installed to be arranged in the circumferential direction of the turbine rotor blade stage 14 as a whole. Each damper piece 100 is provided across the rotor blade bodies 21 of the adjacent turbine rotor blades 20.

Operation and Effect

In the gas turbine 1 with the above-described configuration, when an excitation force acts on the turbine rotor blade 20 during rotation of the turbine rotor blade 20, the excitation force is suppressed by the damper piece 100. That is, when an excitation force acts on the turbine rotor blade 20 to vibrate the turbine rotor blade 20, the damper piece 100 that comes into contact with the first sliding contact surface 61 and the second sliding contact surface 81 of the rotor blade body 21 slides on the first sliding contact surface 61 and the second sliding contact surface 81. Accordingly, a frictional force is generated between the damper piece 100 and the rotor blade body 21 and the frictional force can dissipate the vibration energy. Thus, the vibration damping effect of the turbine rotor blade 20 as a whole can be obtained by the damper piece 100.

Particularly, in this embodiment, the damper piece 100 has an L shape when viewed in the circumferential direction by the first plate portion 110 and the second plate portion 120 and a frictional force is obtained between the first and second plate portions 110 and 120 and both the first sliding contact surface 61 of the base portion 40 and the second sliding contact surface 81 of the fin 70. That is, a frictional force that contributes to vibration damping can be obtained not only between the base portions 40 but also between the fins 70. Therefore, a large vibration damping effect can be obtained for the turbine rotor blade 20 as a whole.

Further, it is possible to reinforce not only the base portion 40 but also the relatively thin and low-strength fins 70 by installing the damper piece 100 including the first plate portion 110 and the second plate portion 120. Thus, the physical strength of the turbine rotor blade 20 as a whole can be ensured.

On the other hand, the first sliding contact surface 61 and the second sliding contact surface 81 with which the first plate portion 110 and the second plate portion 120 come into contact are surfaces formed by cutting a part of the original shape of the rotor blade body 21. That is, the first plate portion 110 and the second plate portion 120 are installed in the cut portion. Therefore, it is possible to suppress an unexpected increase in the weight of the turbine rotor blade 20 as a whole while ensuring high damping performance by the first plate portion 110 and the second plate portion 120. Accordingly, it is possible to further improve performance and reliability by expanding the degree of freedom in design.

Further, in this embodiment, since the damper piece 100 comes into contact with the first contact portion 62 and the second contact portion 82, the damper piece 100 can be appropriately positioned and held with respect to the rotor blade body 21. That is, since the damper piece 100 is provided to stretch between the first contact portion 62 and the second contact portion 82, the damper piece 100 can be slid according to vibration while being properly fixed.

Furthermore, the inner radial end portion of the first plate portion 110 is stopped a movement thereof in the direction of the axis O by the ridge portion 64 of the base portion 40. That is, since the inner radial end portion of the first plate portion 110 is inserted into the damper insertion groove 65, the damper piece 100 can be reliably held with respect to the base portion 40 and the damper piece 100 can be easily attached to the base portion 40.

Further, since the convex portion 122 provided on the second plate portion 120 of the damper piece 100 is fitted into the recessed portion 84 of the fin inner peripheral surface 80, the second plate portion 120 can be positioned and attached more appropriately.

Further, in this embodiment, each of the plurality of damper pieces 100 is provided across the adjacent turbine rotor blades 20. Accordingly, since the gap between the platforms 50 of the adjacent turbine rotor blades 20 can be sealed, the combustion gas G can be suppressed from passing through the gap. Thus, performance as the gas turbine 1 can be improved.

First Modified Example of First Embodiment

Figure 5:
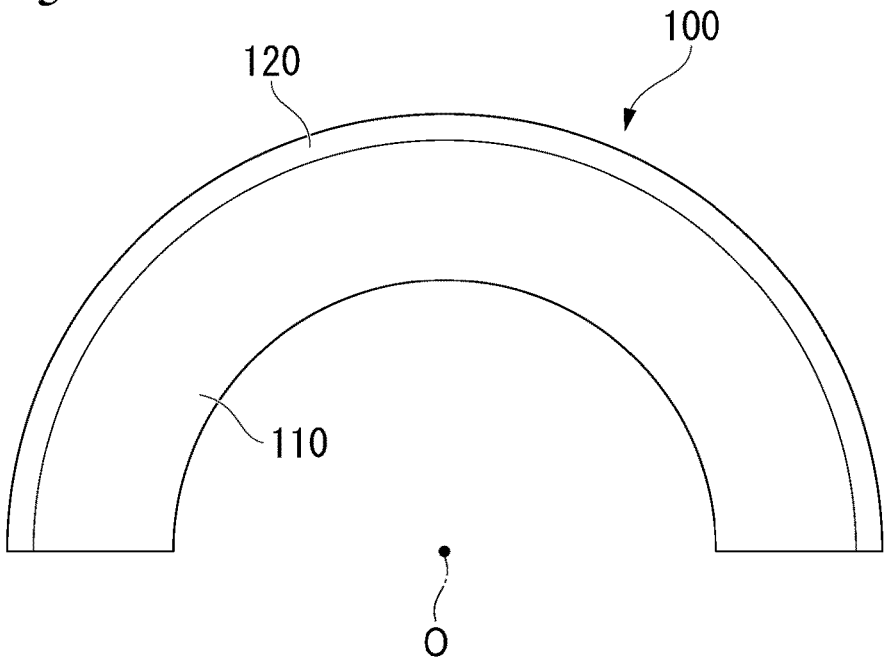
FIG. 5 is a diagram in which a first modified example of the damper piece of the turbine rotor blade according to the first embodiment of the present disclosure is viewed from the axial direction.

For example, as shown in FIG. 5, the damper piece 100 may be provided across the plurality of rotor blade bodies 21 arranged in the circumferential direction. In this case, the first plate portion 110 and the second plate portion 120 of the damper piece 100 have a shape extending in the circumferential direction more than the configuration of the first embodiment, for example, a shape extending over the entire upper half of the gas turbine 1. Accordingly, it is possible to suppress the leakage of the combustion gas G between the base portions 40 of the adjacent turbine rotor blades 20 while obtaining the damping performance of the damper piece 100.

Second Modified Example of First Embodiment

Figure 6:
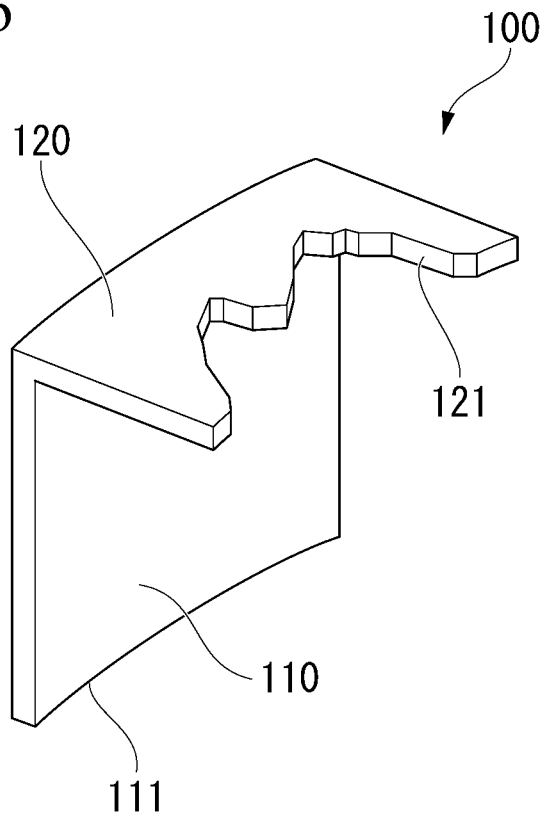
FIG. 6 is a perspective view of a second modified example of the damper piece of the turbine rotor blade according to the first embodiment of the present disclosure.

For example, the damper piece 100 may have a topology optimized configuration as shown in FIG. 6. That is, for example, vibration analysis using the finite element method may be performed on the turbine rotor blade 20 and the shape of the damper piece 100 itself may be optimized so that vibration can be reduced to the maximum. In the example of FIG. 6, an unevenness structure is formed by removing a part of the tip of the second plate portion 120. Accordingly, it is possible to optimize the damping effect and to reduce the weight.

Additionally, the damper piece 100 may be manufactured using a three-dimensional additive manufacturing method based on the topology optimization results. At this time, the damper piece 100 may have a three-dimensional lattice shape.

Second Embodiment

Figure 7:
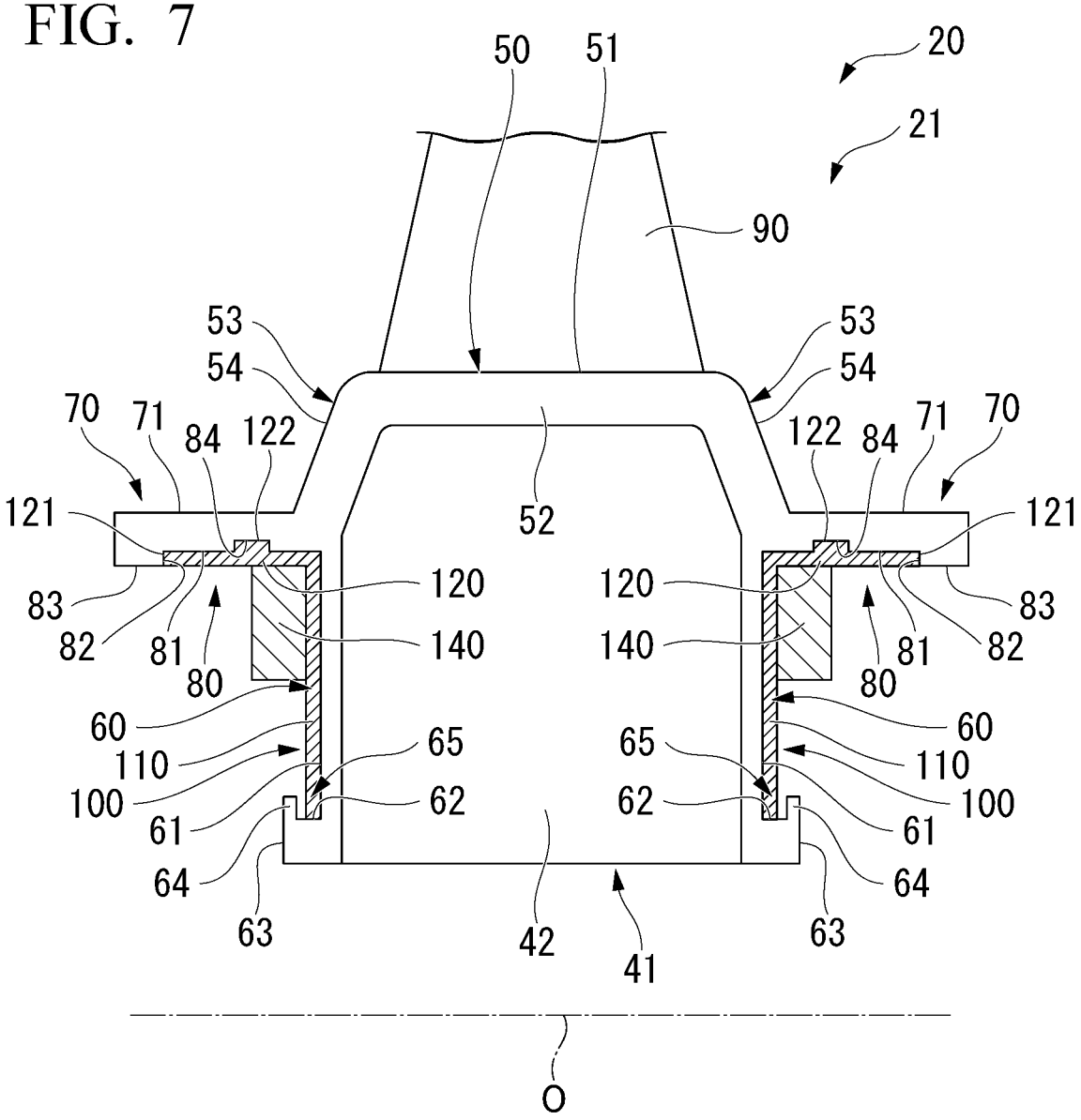
FIG. 7 is a longitudinal sectional view of a main part of a turbine rotor blade according to a second embodiment of the present disclosure.
Figure 8:
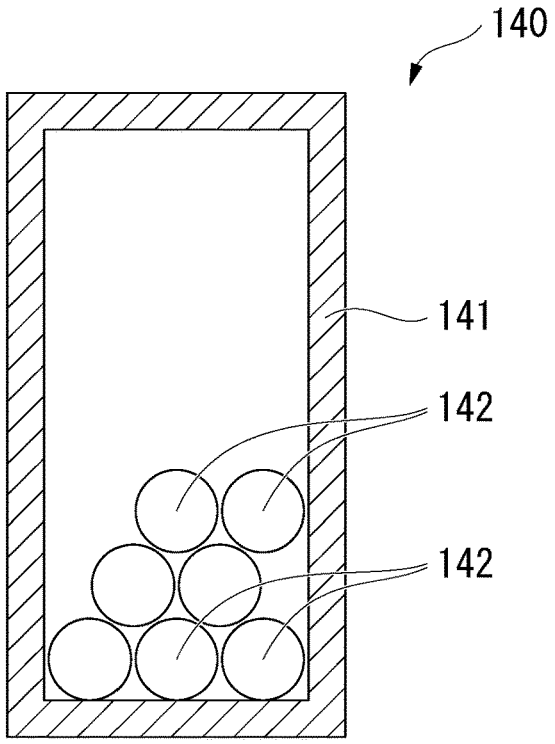
FIG. 8 is a longitudinal sectional view of a damper box of the turbine rotor blade according to the second embodiment of the present disclosure.

Next, a second embodiment of the present disclosure will be described with reference to FIGS. 7 and 8. In FIGS. 7 and 8, components similar to those in the first embodiment are denoted by the same reference numerals and a detailed description thereof is omitted.

As shown in FIG. 7, the turbine rotor blade 20 of the second embodiment includes a damper box 140 in addition to the configuration of the first embodiment.

The damper box 140 is integrally provided in the damper piece 100. As shown in FIG. 8, the damper box 140 includes a box main body 141 and a spherical damper 142 which is a moving damper.

The box main body 141 has a rectangular box shape and is made of the same material as the damper piece 100 or another steel material. Two outer surfaces of the box main body 141 are integrally fixed to the first plate portion 110 and the second plate portion 120 of the damper piece 100. A space is formed inside the box main body 141.

The spherical damper 142 is a sphere made of the same material as the damper piece 100 or the same material as the box body 141. A plurality of the spherical dampers 142 are provided to be accommodated in the space inside the box main body 141. The spherical damper 142 is allowed to freely move in the space inside the box main body 141.

Operation and Effect

According to the turbine rotor blade 20 of the second embodiment, the vibration damping effect of the damper box 140 can be obtained in addition to the operation and effect of the first embodiment.

That is, when an excitation force acts on the turbine rotor blade 20 to cause vibration, the spherical damper 142 inside the box main body 141 collides with and slides on the inner surface of the box main body 141. Accordingly, the vibration of the turbine rotor blade 20 can be dissipated as collision energy and frictional energy. Therefore, the effect of damping the vibration of the turbine rotor blade 20 can be obtained.

Further, it is possible to obtain a higher vibration damping effect of the turbine rotor blade 20 as a whole by using the damper piece 100 and the damper box 140 together.

Modified Example of Second Embodiment

Figure 9:
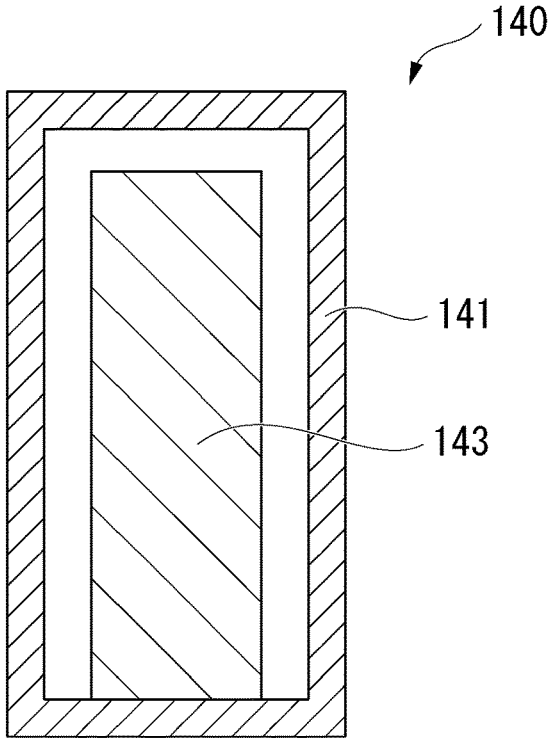
FIG. 9 is a longitudinal sectional view of a damper box according to a modified example of the turbine rotor blade of the second embodiment of the present disclosure.

Additionally, for example, as shown in FIG. 9, a plate-shaped damper 143 which is allowed to move inside the box main body 141 may be adopted as the moving damper accommodated inside the box main body 141 of the damper box 140. The plate-shaped dampers 143 are accommodated with their outer surfaces facing the inner surfaces of the box main body 141.

When the turbine rotor blade 20 is vibrated, the plate-shaped damper 143 collides with and slides on the inner surface of the box main body 141. Also, the high vibration damping effect can be obtained as described above.

Additionally, as the moving damper, not only the spherical damper 142 and the plate-shaped damper 143 but also various shapes can be adopted.

OTHER EMBODIMENTS

Although the embodiments of the present disclosure have been described above, the present disclosure is not limited thereto and can be modified as appropriate without departing from the technical idea of the disclosure.

For example, in the embodiment, an example has been described in which the pair of fins 70 are provided on the upstream side and the downstream side and the damper piece 100 is provided on both the upstream side and the downstream side to correspond to these fins 70, but the disclosure is not limited thereto. The damper piece 100 may be provided in at least one of the upstream side and the downstream side.

Furthermore, in the second embodiment, an example has been described in which the pair of damper boxes 140 are provided to correspond to the pair of damper pieces 100, but the damper box 140 may be provided only in any one damper piece 100.

APPENDIX

The turbine rotor blade 20 and the turbine 11 described in each embodiment is understood, for example, as below.

(1) The turbine rotor blade 20 according to a first aspect includes: the rotor blade body 21 which includes the blade root 30 fixed to the rotation shaft extending along the axis O, the base portion 40 integrally formed on the outer radial side of the blade root 30, the blade body 90 integrally formed on the outer radial side of the base portion 40, and the fin 70 protruding from the axial end surface 53 of the base portion 40; and the damper piece 100 which is provided across the inner peripheral region 60 of the axial end surface 53 on the inner radial side of the fin 70 and the fin inner peripheral surface 80 facing the inner radial side.

With the above-described configuration, when an excitation force acts on the turbine rotor blade 20 during the rotation of the turbine rotor blade 20, the damper piece 100 which contacts the inner peripheral region 60 of the base portion 40 of the turbine rotor blade 20 and the fin inner peripheral surface 80 of the fin 70 slides on the inner peripheral region 60 and the fin inner peripheral surface 80 to cause a frictional force. Accordingly, it is possible to obtain the vibration damping effect due to the frictional force. That is, since it is possible to obtain a frictional force in a wide region such as the inner peripheral region 60 and the fin inner peripheral surface 80, it is possible to obtain a large damping effect for the turbine rotor blade 20 as a whole.

Furthermore, since the damper piece 100 can ensure the physique of the base portion 40 and the fin 70, it is possible to improve the strength of the turbine rotor blade 20 as a whole.

(2) The turbine rotor blade 20 according to a second aspect is the turbine rotor blade of the first aspect, wherein the damper piece 100 may include the first plate portion 110 which has a plate shape extending in the radial direction and the circumferential direction so that the first plate portion comes into contact with the inner peripheral region 60 and the second plate portion 120 which is connected to the outer radial end portion of the first plate portion 110 and is extended in the direction of the axis O and the circumferential direction to come into contact with the fin inner peripheral surface 80.

Since the first plate portion 110 comes into contact with the inner peripheral region 60 of the base portion 40 and the second plate portion 120 comes into contact with the fin inner peripheral surface 80, it is possible to appropriately reduce the excitation force acting on the turbine rotor blade 20.

Furthermore, it is possible to ensure the physique of the base portion 40 and the fin 70 by the first plate portion 110 and the second plate portion 120.

(3) The turbine rotor blade 20 according to a third aspect is the turbine rotor blade of the second aspect, wherein the base portion 40 may include the first contact portion 62 onto which the inner radial end portion of the first plate portion 110 is fitted, and the fin 70 may include the second contact portion 82 onto which the tip of the second plate portion 120 is fitted in the direction of the axis O.

Since the ends of the damper piece 100 come into contact with the first contact portion 62 and the second contact portion 82, it is possible to appropriately position and hold the damper piece 100 with respect to the base portion 40.

(4) The turbine rotor blade 20 according to a fourth aspect is the turbine rotor blade of the third aspect, wherein the base portion 40 may further include the ridge portion 64 which is extended in the circumferential direction to stand in front of the inner radial end portion of the first plate portion 110 in the direction of the axis O.

Accordingly, it is possible to reliably hold the damper piece 100 with respect to the base portion 40 and to easily attach the damper piece 100 to the base portion 40.

(5) The turbine rotor blade 20 according to a fifth aspect is the turbine rotor blade of any one of the second to fourth aspects, wherein the recessed portion 84 which is recessed toward the inner radial side may be formed in a part of the fin inner peripheral surface 80 and the convex portion 122 which is fitted into the recessed portion 84 may be formed on a surface facing the outer radial side of the second plate portion 120 in the damper piece 100.

Accordingly, it is possible to more appropriately position and attach the second plate portion 120 of the damper piece 100 to the fin inner peripheral surface 80.

(6) The turbine rotor blade 20 according to a sixth aspect is the turbine rotor blade of any one of the first to fifth aspects, further including: the box main body 141 which is fixed to the damper piece 100; and the moving damper which is allowed to move inside the box main body 141.

When an excitation force acts on the turbine rotor blade 20, the moving damper inside the damper box 140 collides with or slides on the inner surface of the damper box 140. Accordingly, it is possible to more appropriately reduce the excitation force.

(7) The turbine 11 according to a seventh aspect includes: the rotation shaft; and the turbine rotor blades 20 according to any one of the first to sixth aspects arranged on the rotation shaft in the circumferential direction, wherein the damper piece 100 is provided across the rotor blade bodies 21 adjacent to each other in the circumferential direction.

It is possible to seal the gap between the adjacent turbine rotor blades 20 by the damper piece 100. Thus, it is possible to improve the performance of the gas turbine 1.

INDUSTRIAL APPLICABILITY

According to the present disclosure, it is possible to provide the turbine rotor blade and the turbine capable of improving vibration damping properties while ensuring physical strength.

REFERENCE SIGNS LIST

1 Gas turbine
2 Gas turbine casing
3 Gas turbine rotor shaft
4 Compressor
5 Intake duct
6 Compressor casing
7 Compressor rotor shaft
8 Compressor rotor blade stage
8*a* Compressor rotor blade
9 Compressor stator blade stage
9*a* Compressor stator blade
10 Combustion chamber
11 Turbine
12 Turbine rotor shaft (rotation shaft)
13 Turbine casing
14 Turbine rotor blade stage
15 Turbine stator blade stage
15*a* Turbine stator blade
16 Exhaust nozzle
17 Injection port
20 Turbine rotor blade
21 Rotor blade body
30 Blade mot
40 Base portion
41 Shank
42 Shank end surface
50 Platform
51 Outer peripheral end surface
52 Circumferential end surface
53 Axial end surface
54 Outer peripheral region
60 inner peripheral region
61 First sliding contact surface
62 First contact portion
63 Inner peripheral end surface
64 Ridge portion
65 Damper insertion groove
70 Fin
71*a* Fin circumferential end surface
71 Fin outer peripheral surface
80 Fin inner peripheral surface
81 Second sliding contact surface
82 Second contact portion
83 Tip inner surface
84 Recessed portion
90 Blade body
91 Shroud
100 Damper piece
110 First plate portion
120 Second plate portion
122 Convex portion
140 Damper box
141 Box main body
142 Spherical damper (moving damper)
143 Plate-shaped damper (moving damper)
F Fuel
G Combustion gas
O Axis

What is claimed is:

1. A turbine rotor blade comprising:

a rotor blade body which includes a blade root fixed to a rotation shaft extending along an axis, a base portion integrally formed on the outer radial side of the blade root, a blade body integrally formed on the outer radial side of the base portion, and a fin protruding from an axial end surface of the base portion; and a damper piece which is provided across an inner peripheral region of the axial end surface on the inner radial side of the fin and a fin inner peripheral surface facing the inner radial side of the fin, wherein the damper piece includes:

a first plate portion which has a plate shape having a surface extending in a radial direction and a circumferential direction so that the first plate portion comes into surface-contact with the inner peripheral region; and a second plate portion which is connected to an outer radial end portion of the first plate portion and having a surface extending in a direction of the axis and a circumferential direction so as to come into surface-contact with the inner peripheral surface of the fin.

2. The turbine rotor blade according to claim 1, wherein the base portion includes a first contact portion onto which an inner radial end portion of the first plate portion is fitted, and wherein the fin includes a second contact portion onto which an axial tip of the second plate portion is fitted.

3. The turbine rotor blade according to claim 2, wherein the base portion further includes a ridge portion which is extended in a circumferential direction to stand in front of an inner radial end portion of the first plate portion in the direction of the axis.

4. The turbine rotor blade according to claim 1, wherein a recessed portion which is recessed toward the outer radial side is formed in a part of the inner peripheral surface of the fin, and wherein a convex portion which is fitted into the recessed portion is formed on a surface facing the outer radial side of the second plate portion in the damper piece.

5. The turbine rotor blade according to claim 1, further comprising:

a box main body which is fixed to the damper piece; and a moving damper which is allowed to move inside the box main body.

6. The turbine rotor blade according to claim 1, wherein the inner peripheral region has a first sliding contact surface that has a planar shape extending in the circumferential direction and the radial direction, the fin inner peripheral surface has a second sliding contact surface that extends in the direction of the axis and the circumferential direction, the first plate portion comes into surface-contact with the first sliding contact surface of the base portion, and the second plate portion comes into surface-contact with the second sliding contact surface of the fin.

7. A turbine comprising:

the rotation shaft; and the turbine rotor blades according to claim 1 arranged on the rotation shaft in a circumferential direction, wherein the damper piece is provided across the rotor blade bodies adjacent to each other in the circumferential direction.

* * * * *